US005823532A

United States Patent [19]

Goldwasser et al.

[11] Patent Number: 5,823,532

[45] Date of Patent: Oct. 20, 1998

[54] WINDOW PUZZLE

[75] Inventors: Gail S. Goldwasser, Los Angeles; Linda M. Hawkins, Santa Monica; Beth A. Rosenblatt, Redondo Beach, all of Calif.

[73] Assignee: Small World Toys, Redondo Beach, Calif.

[21] Appl. No.: 931,146

[22] Filed: Sep. 16, 1997

[51] Int. Cl.[6] ..... A63F 9/12

[52] U.S. Cl. ..... 273/157 R; 273/157 A

[58] Field of Search ..... 273/157 R, 157 A, 273/156, 153 R; 434/171, 172, 176, 193, 195, 196, 403

[56] References Cited

U.S. PATENT DOCUMENTS

| | | | |
|---|---|---|---|
| 3,766,668 | 10/1973 | Vogel | 434/403 |
| 3,888,025 | 6/1975 | Schmieder | 273/157 R |
| 4,487,585 | 12/1984 | Goldwasser | 434/259 |
| 4,822,051 | 4/1989 | Nowak et al. | 273/157 R |
| 5,257,785 | 11/1993 | Sugie | 273/157 R |
| 5,577,728 | 11/1996 | Kondo | 273/157 A |
| 5,716,212 | 2/1998 | Lee | 434/172 |

OTHER PUBLICATIONS

"Yellow Fish • Blue Fish", a Tiny Magic Window®, Readers Digest Young Families, Inc., Victoria House Publishing, Ltd. 1994.

*Primary Examiner*—Steven Wong
*Attorney, Agent, or Firm*—Small Larkin, LLP

[57] ABSTRACT

A puzzle including a puzzle board having a backing, a plurality of cavities, and a plurality of puzzle pieces, each puzzle piece having a frame, or outer periphery shaped and sized to conform to the inner walls or inner periphery of a corresponding cavity in the puzzle board, and each of the puzzle pieces including a frame with an open, central area or window and having a clear film, preferably an acetate, extending thereacross, the bottom surface of each cavity having an image formed thereon, and the clear film also having an image formed thereon, whereby placement of a puzzle piece into a cavity provides for completion of the puzzle and the super-imposition of the puzzle piece insert image upon the background image at the bottom of the cavity.

13 Claims, 2 Drawing Sheets

FIG. 5
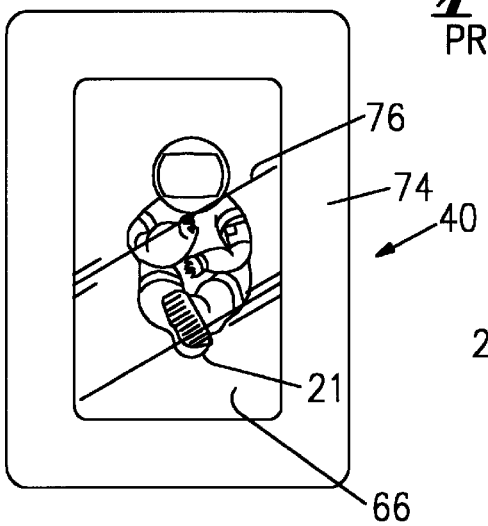
FIG. 1
PRIOR ART
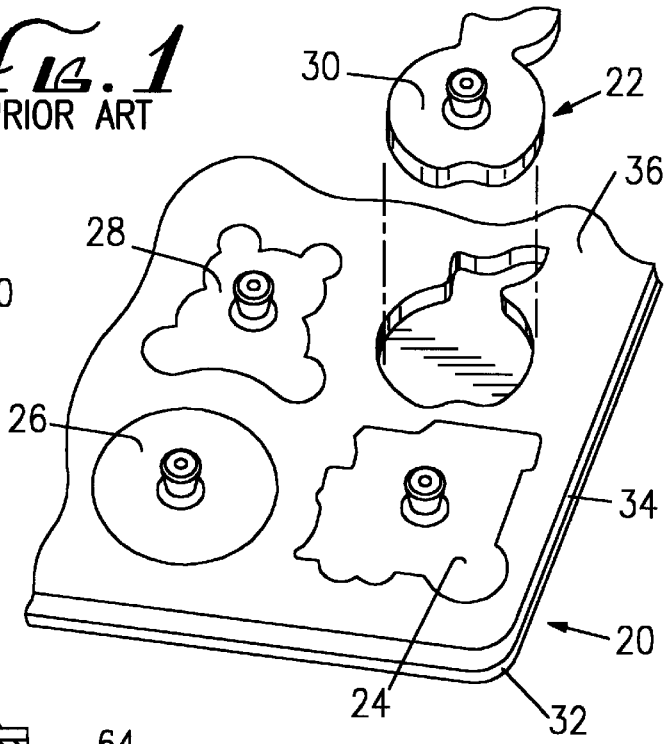
FIG. 4
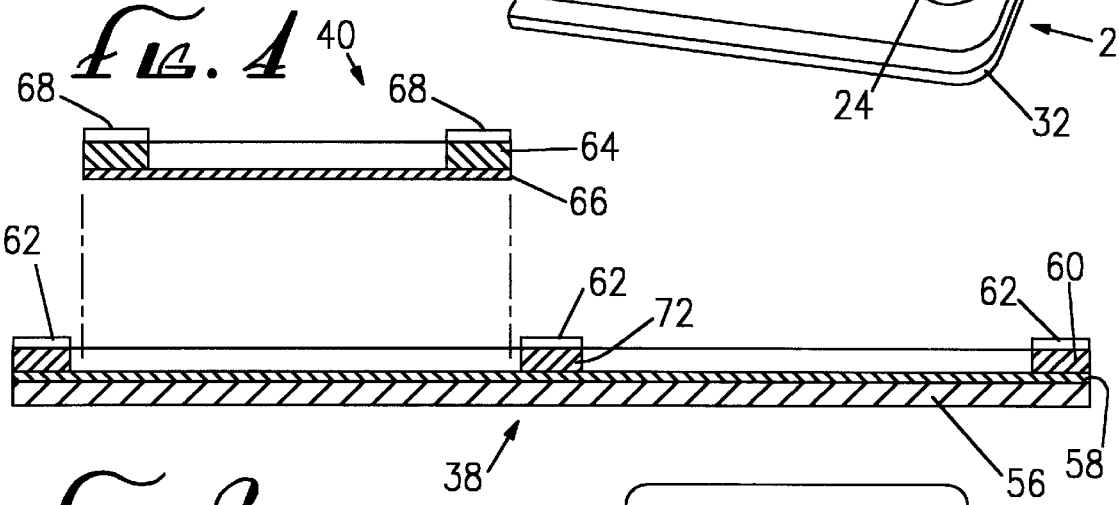
FIG. 3
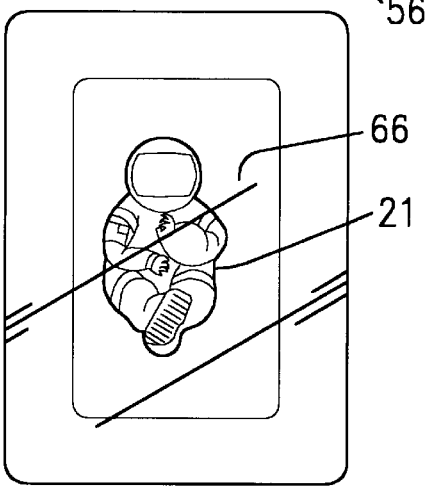
FIG. 6

WINDOW PUZZLE

A portion of the disclosure of this patent document contains materials which is subject to copyright protection. The copyright owner has no objection to the facsimile reproduction by anyone of the patent document or the patent disclosure, as it appears in the Patent and Trademark Office file or records, but otherwise reserves all copyright rights whatsoever.

BACKGROUND OF THE INVENTION

A. Field of the Invention

The present invention is directed to a puzzle having a puzzle board containing a plurality of cavities, a plurality of puzzle pieces adapted to fit into the cavities, with the puzzle pieces being a frame having an open, central area across which a transparent film extends, and with an image printed on the film and the top surface of the cavity.

B. Description of the Prior Art

Board puzzles using a wooden puzzle board having cavities, or recesses, puzzle pieces of various configurations are known and described, for example, in U.S. Pat. No. 4,487,585. Conventional puzzles of this type, however, use a solid puzzle piece. Books having an open area in the center of the page, with a clear film extending across the open area and having an image printed thereon are also known.

OBJECTS AND SUMMARY OF THE INVENTION

It is an object of the invention to provide a board puzzle having a puzzle board with cavities, and puzzle pieces having a clear film extending across an open area of the puzzle piece.

It is a further object of the present invention to provide a board puzzle having a puzzle board with a plurality of cavities and a plurality of puzzle piece frames, with an acetate film extending across the open region of the puzzle piece frame.

It is a further object of the present invention to provide a board puzzle having a puzzle board with a plurality of cavities, a plurality of correspondingly shaped puzzle piece frames, the puzzle piece frames having a clear membrane or film extending across the central region and having an image formed on the film.

With reference to the above-described objects, the present invention provides a board puzzle having a multi-ply puzzle board with a plurality of cavities, a plurality of correspondingly shaped puzzle piece frames for insertion into the cavities, and the puzzle piece frames having a clear film extending across the open area of the frame. Also, preferably, the bottom of the cavity of the puzzle board includes a design or image and the clear film also includes a design or image thereon. The design or image of the membrane optionally, corresponds, in some meaningful way, to the design or shape in a corresponding cavity. Preferably the puzzle board is made of plywood, with art print paper used for the surface of the cavity, and the puzzle piece is a multi-ply construction with the bottom ply being plywood, the middle ply being a clear film, preferably of an acetate having a color printing there-on, and the upper ply being plywood with a wood grain paper upper surface. The puzzle board art print paper is laminated to the puzzle board, and includes, preferably a printing of a design, background scene, or other image.

BRIEF DESCRIPTION OF THE DRAWINGS

FIG. 1 is an exploded, perspective view of a prior art puzzle within the field of the invention.

FIG. 3 is a cross-sectional view of the puzzle board of the FIG. 2 embodiment.

FIG. 4 is a cross-sectional view of a puzzle piece insert of the FIG. 2 embodiment.

FIG. 5 is a top view of the FIG. 4 puzzle piece.

FIG. 6 is a bottom view of the FIG. 4 puzzle piece.

DESCRIPTION OF THE PREFERRED EMBODIMENTS

Figure 2:
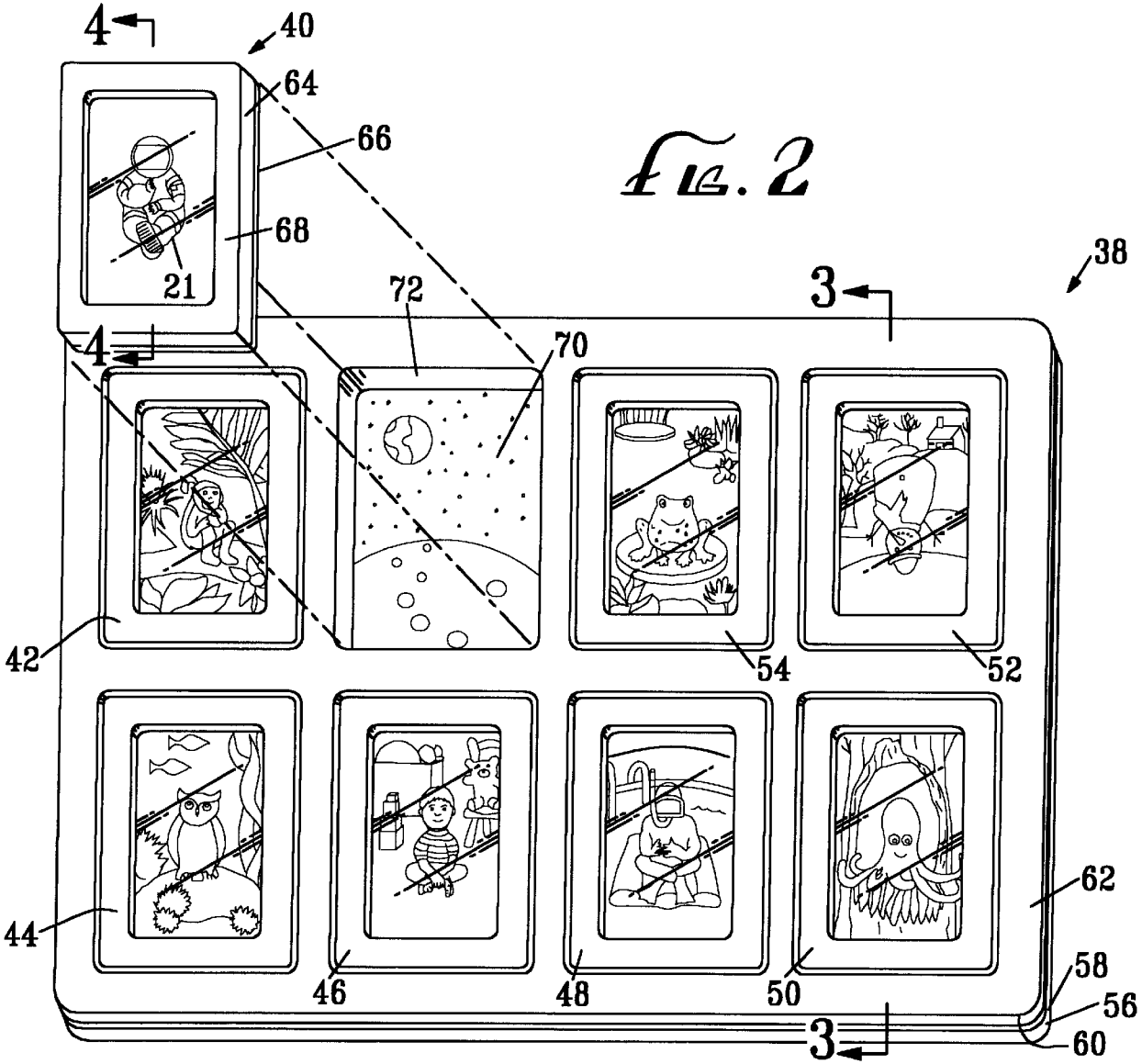
FIG. 2 is an exploded perspective view of a preferred embodiment of the present invention.

Referring to FIG. 1, a prior art board puzzle within the field of the invention is illustrated having multi-ply, multi-cavity puzzle board 20 and a plurality of corresponding puzzle pieces 22, 24, 26 and 28. Each puzzle piece includes a knob, such as knob 30 as shown fixed to puzzle piece 22. The puzzle board 20 typically includes a bottom ply 32 which is wood, a middle ply 34 which is also typically of a wood material, and a third ply, or upper surface 36 which typically is a wood grain paper laminate. As shown in FIG. 1, the cavities of the puzzle board may be formed in various shapes such as a geometric shape, e.g., a circle for piece 26, a train engine 24, an apple 22 and a teddy bear 28. Board puzzles of this type are intended for use by small children, typically ages 7 and younger, for play as well as for educational and developmental purposes.

Referring to FIG. 2, a preferred embodiment of the present puzzle board invention is illustrated showing the puzzle board 38 and a plurality of puzzle pieces 40, 42, 44, 46, 48, 50, 52, and 54. In the preferred embodiment, the puzzle board 38 is of a four-ply construction including the bottom ply 56, an intermediate ply or layer 58 preferably made of a art print paper, an intermediate ply or layer 60 preferably of plywood, and a top layer 62 preferably made of a wood grain paper.

Puzzle piece insert 40 also is of a multi-ply construction including a center ply 64, preferably made of plywood, a bottom ply 66 of a clear material, preferably an acetate film, and a top layer 68, preferably made of a wood grain paper. The puzzle board and puzzle pieces (except for the clear film center) may also be made of wood, plastic, masonite board or an equivalent material. Preferably the film has printed thereon an image or design, such as the image of an astronaut 21, as shown in FIG. 2 for puzzle piece insert 40. As may also be seen from FIG. 2, the puzzle board 38 has a plurality of recesses or cavities corresponding to each of the puzzle pieces, each cavity having a bottom surface, shown at 70, with respect to the puzzle piece 40, and a side wall with a depth or height as shown at 72. Preferably, the bottom of each cavity is the top surface of the art print paper 58 and has a design or background image printed thereon. For example, the bottom surface of the cavity 70 has printed thereon a scene of space, with a moon or some planet in the foreground, the earth in the background and a plurality of small dots representative of stars also in the background. This space scene background corresponds to the astronaut image 21 printed on the film 66 of puzzle piece 40.

In FIG. 2 the plurality of cavities, and corresponding puzzle pieces are shaped in the form of rectangles, with each puzzle piece having a height, and the cavity having a depth corresponding to depth 72 as shown. As may be appreciated, the cavities and corresponding puzzle piece inserts may have a wide variety of shapes, such as illustrated in FIG. 1. Whereas in the FIG. 1 puzzle different shapes for the various puzzle pieces and cavities facilitates learning by providing for matching the appropriate shape to the appropriate cavity, a puzzle board configuration shown in FIG. 2 has identical shapes for the cavities and identical shapes for the puzzle pieces, with the differences residing in the printed material on the surface of the cavity and on the film extending across the central open region surrounded by the frame of each of the puzzle pieces. In this way, the child may learn to associate a particular puzzle piece image with a particular background printed on the surface of a cavity in the puzzle board. For example, the puzzle piece 42 may have a monkey in a sitting position with the cavity background having a jungle scene printed thereon. Similarly, puzzle piece 54 has a frog image on its acetate film, and a background scene of a pond with lily pads. Puzzle piece 52 is shown with a snowman image on the acetate film, inserted in an upside down position with respect to its background winter scene having trees and a house in the upper right hand corner.

Similarly, puzzle piece 44 is shown with an owl image, but placed in the cavity having an underwater scene with two fish, and various marine plants also shown on the left, bottom and right hand portion of the cavity. Puzzle piece 46 is shown having a child in a sitting position on the acetate film, with the background being a stack of four blocks on the left, a toy box having a ball and a toy horse head in the upper left, and a chair with a teddy bear sitting thereon in the upper right. Puzzle piece 48 has an image on its acetate film of a diver with a mask and snorkel placed in the cavity having a swimming pool and floating cushion background. The puzzle piece 50 is shown having an octopus on its acetate film and the puzzle piece placed in a cavity having a tree trunk with an opening and various grasses and leaves extending therefrom to form an owl's nest. As may be appreciated, the various puzzle pieces may be arbitrarily placed in any of the identical cavities, or with placement of a particular puzzle piece chosen to correspond to a particular background. For example, a typical puzzle piece figure and background would be the astronaut in the space scene. Also, a fanciful association would be the owl in the underwater background scene.

Referring to FIG. 3, a cross-sectional view of the board puzzle of the present invention is shown. First, referring to puzzle board 38, the first, or bottom ply 56 is shown as extending across the entire back of the puzzle board. The puzzle board 56 bottom ply is preferably of plywood, but may also be made of other materials such as masonite board, wood, plastic or other materials so long as it provides sufficient stability and support for the puzzle. For example, although masonite may be a more hard and desirable material, it is also heavier and thus, less desirable. Laminated onto the top surface of the first ply 56 is second ply, or intermediate ply 58. Second ply 58 is preferably an art print paper of the type which may be laminated onto the first ply 56 and upon which various scenes, images or words may be printed.

Third ply 60 is fastened to the puzzle board, preferably by gluing, or other conventional means to provide for a plurality of cavities as shown in FIGS. 2 and 3. The third ply 60 is also preferably made of plywood, and has a plurality of cavities, of predetermined shapes, sizes and locations cut therein. The third ply 60 may be made of other materials, such as wood, plastic, heavy paper and the like, but plywood is the preferred material of construction. The thickness or depth of the third ply 60 is optional, but preferably is approximately ¼ inch. Also, as may be appreciated, the third ply 60, as well as the first ply 56, may itself be made of a plurality of layers or plys, not shown.

On top of third ply 60 a fourth ply, or top layer 62 provide the top surface of the puzzle board. Top surface or fourth ply 62 is preferably of a wood grain paper of the type which may be laminated to or glued to the top surface of third ply 60. The top surface 62 is preferably made of a wood grain paper because it provides a more pleasing appearance than does the surface of conventional plywood. The wood grain paper has a more pleasing wood grain and typically a more natural appearing wood color. As may be appreciated, other covering materials may be used for top surface 62.

Referring to FIG. 4, the puzzle piece 40 includes a first, or bottom ply 66, shown extending across the entire width of the puzzle piece. The bottom ply 66 also is fastened to, by gluing or other conventional means, and extends across the entire length of the puzzle piece, thereby covering, preferably the entire surface area of the bottom surface of the puzzle piece. The bottom ply 66 is of a clear membrane or film, preferably of an acetate, or a polyvinylchloride ("PVC") material. The film may also be of other clear materials, such as polyethylene terephthalate ("PET"). Also, preferably, the ply or film 66 has a color image printed thereon, and as described above with respect to FIG. 2. Intermediate or second ply 64 is preferably made of plywood, and corresponds to the third ply 60 of the puzzle board, as described above with respect to FIG. 3. As may be appreciated, the puzzle piece second ply 64 may be made of a single layer or single ply plywood, or alternatively may be made of multiple layers of plywood or multiple plys, as may be the layers 56 and/or 60 of the puzzle board 38. The ply 64 defines a rectangular frame having an outer periphery which corresponds to the inner periphery of the cavity side walls, and having an inner periphery which defines the central, open area across which the clear film extends.

Also, not shown, as an alternative preferred embodiment, the clear film 66 may be included as one of the intermediate layers of a multi-layer or multi-ply puzzle piece. In such a construction, the puzzle piece 40 would have its film 66 intermediate to an upper plywood layer from and to a lower plywood layer frame.

As may be appreciated from FIGS. 3 and 4, the puzzle piece 40 is of a frame shape, i.e., having a central open region which may be circular, rectangular, square or of some other geometric form, surrounded by a solid border or rim 74. The open, central region or area 76 of the puzzle piece may be of a rectangular form, as shown in FIG. 5, or may be of other shapes having complex curves and/or shapes, not shown. With respect to the film or membrane extending across the open region 76, a polyvinylchloride film is preferred, with PET also being useful. PET is not as preferred, for the reason that it collects static electricity during the color printing process used to place images thereon, and thus causes quality control problems.

As shown in FIGS. 4–6, the clear film 66 is placed on the bottom with respect to the ply or plys 64. In FIG. 6, the clear film ply 66 is shown on the top, with the image of the astronaut 21 in FIG. 6 being a mirror image of that shown in FIG. 5.

In use, the puzzle pieces and the puzzle board are first separated. Then individual puzzle pieces are placed into one of the cavities of the puzzle board by the child. As may be appreciated, the child may place the puzzle piece into a cavity having a corresponding background, such as the astronaut puzzle piece 40 in the cavity having the space background 70, and in the normal configuration, or may place the puzzle piece in different cavities and/or with different configurations. For example, the puzzle piece 52 snowman is placed in the corresponding winter scene background cavity, but has been placed in an upside down configuration. Thus, the puzzle pieces, having designs as indicated above, may serve both an educational as well as a play purpose for the young child.

It will be understood that certain features and subcombinations are of utility and may be employed without reference to other features and subcombinations as they are outlined within the description above and within the claims appended hereto. While the preferred embodiments and application of the invention have been described, it is apparent to those skilled in the art that the objects and features of the present invention are only limited as set forth in the claims appended hereto.

I claim:

1. A puzzle comprising:

a rectangular board having a predetermined length, width, height and made of a predetermined material;

a backing attached to one side of said board and extending over the length and width of said board;

at least one cavity in said board, each cavity having a predetermined shape;

at least one puzzle piece, each puzzle piece having a frame with an outer periphery and an inner periphery defining a central opening in said frame, said outer periphery shaped to conform to said cavity; and a transparent film extending across said central opening and including printed matter on said transparent film.

2. The puzzle of claim 1 further including printed matter on the surface of said cavity.

3. A puzzle comprising:

a multi-ply board having at least one cavity and having at least one puzzle piece sized and shaped to be insertable into said cavity;

said puzzle piece further comprising a frame with an open central region, a clear film extending across the open central region and including printed matter thereon.

4. The puzzle of claim 3 further including printed matter on a first surface of said cavity.

5. The puzzle of claim 3 wherein said clear film is an acetate.

6. The puzzle of claim 3 further including a first image printed on a first surface of said cavity and a second image printed on said clear film.

7. A board puzzle comprising a multi-ply board having a plurality of recesses on a first surface and a plurality of puzzle pieces sized and shaped to be held by and conformed to said recesses;

said board including a first ply being of a predetermined shape and defining the length and width of said puzzle board, a second ply having one surface adapted to receive and retain printed matter, and a third ply having a plurality of bores therein defining said plurality of recesses;

each of said puzzle pieces having at least one ply made of a solid material having a bore therethrough defining a frame and sized and shaped to be inserted into one of said recesses of said board, and having a second ply being made of a transparent material and extending across said frame.

8. The board puzzle of claim 7 wherein said multi-ply board further includes an additional ply affixed to said third ply and defining a top surface thereof.

9. The board puzzle of claim 7 further including a third ply affixed to each of said puzzle pieces, and defining a top surface thereof.

10. The board puzzle of claim 7 further including printed matter on a first surface of said second ply of said multi-ply board.

11. The board puzzle of claim 7 further including printed matter placed on said transparent material of each of said puzzle pieces.

12. The board puzzle of claim 7 wherein each of said cavities is of a rectangular shape and each of said puzzle pieces is of a rectangular shape.

13. The board puzzle of claim 7 wherein said first and second plys of said multi-ply board are plywood, said transparent ply of said puzzle piece is an acetate and said solid ply of said puzzle piece is plywood.

* * * * *